US011739768B2

(12) United States Patent
Chen et al.

(10) Patent No.: US 11,739,768 B2
(45) Date of Patent: Aug. 29, 2023

(54) FAN AND HOUSING DEVICE THEREOF

(71) Applicant: Yen Sun Technology Corp., Kaohsiung (TW)

(72) Inventors: Graham Chen, Kaohsiung (TW); Chih-Tsung Hsu, Kaohsiung (TW); Hsin-Hsien Wu, Kaohsiung (TW); Chin-Hui Pan, Kaohsiung (TW)

(73) Assignee: YEN SUN TECHNOLOGY CORP., Kaohsiung (TW)

( * ) Notice: Subject to any disclaimer, the term of this patent is extended or adjusted under 35 U.S.C. 154(b) by 0 days.

(21) Appl. No.: 17/747,891

(22) Filed: May 18, 2022

(65) Prior Publication Data

US 2023/0204047 A1 Jun. 29, 2023

(30) Foreign Application Priority Data

Dec. 28, 2021 (TW) ..... 110149142

(51) Int. Cl.
*F04D 29/66* (2006.01)
*F04D 19/00* (2006.01)
*F04D 29/60* (2006.01)

(52) U.S. Cl.
CPC ..... *F04D 29/663* (2013.01); *F04D 19/002* (2013.01); *F04D 29/601* (2013.01)

(58) Field of Classification Search
CPC ..... F04D 29/663; F04D 19/002; F04D 29/601
See application file for complete search history.

(56) References Cited

U.S. PATENT DOCUMENTS

2004/0076514 A1* 4/2004 Horng ..... F04D 29/545 415/177

FOREIGN PATENT DOCUMENTS

CN 107023499 A * 8/2017 ..... F04D 25/08

OTHER PUBLICATIONS

Machine Translation of CN 107023499 A PDF File Name: "CN107023499A_Machine_Translation.pdf".*

* cited by examiner

*Primary Examiner* — Grant Moubry
*Assistant Examiner* — Ruben Picon-Feliciano
(74) *Attorney, Agent, or Firm* — Muncy, Geissler, Olds & Lowe, P.C.

(57) ABSTRACT

A fan includes a frame member, a fan body, a surrounding plate and a housing unit. The frame member surrounds an axis and defines an accommodating space in which the fan body is disposed. The fan body is rotatable about the axis. The surrounding plate surrounds the frame member and is formed with at least one plate hole extending in a transverse direction transverse to an axial direction of the axis therethrough. The housing unit surrounds the surrounding plate and has a plurality of housing holes extending in the axial direction of the axis therethrough. The housing unit and the surrounding plate cooperatively define a surrounding space therebetween that is surrounded by the housing holes.

4 Claims, 4 Drawing Sheets

FAN AND HOUSING DEVICE THEREOF

CROSS-REFERENCE TO RELATED APPLICATION

This application claims priority to Taiwanese Invention Patent Application No. 110149142, filed on Dec. 28, 2021.

FIELD

The disclosure relates to a fan, and more particularly to a fan that has a noise-reducing housing device.

BACKGROUND

During the operation of a conventional fan, the conventional fan urges air to flow therethrough. When the air flows through the conventional fan, components of the conventional fan, such as fan blades, vibrate and generate noise with different frequencies. When one of the frequencies is a positive integer multiple of another one of the frequencies that is lower than it, resonance occurs, which makes the noise louder.

SUMMARY

Therefore, an object of the disclosure is to provide a fan that can alleviate the drawback of the prior art.

According to the disclosure, the fan includes a rotating unit and a housing device. The rotating unit includes a frame member and a fan body. The frame member surrounds an axis and defines an accommodating space. The fan body is disposed in the accommodating space and is rotatable about the axis. The housing device surrounds the rotating unit and includes a surrounding plate and a housing unit. The surrounding plate surrounds the frame member and is formed with at least one plate hole that extends in a transverse direction transverse to an axial direction of the axis therethrough. The housing unit surrounds the surrounding plate and has a plurality of housing holes that extend in the axial direction of the axis therethrough. The housing unit and the surrounding plate cooperatively define a surrounding space therebetween. The housing holes are disposed in a multi-row arrangement to surround the surrounding space.

Another object of the disclosure is to provide a housing device that can alleviate the drawback of the prior art.

According to the disclosure, the housing device is adapted for a fan, and includes a surrounding plate and a housing unit. The surrounding plate surrounds an axis and is formed with at least one plate hole that extends in a transverse direction transverse to an axial direction of the axis therethrough. The housing unit surrounds the surrounding plate and has a plurality of housing holes that extend in the axial direction of the axis therethrough. The housing unit and the surrounding plate cooperatively define a surrounding space therebetween. The housing holes are disposed in a multi-row arrangement to surround the surrounding space.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
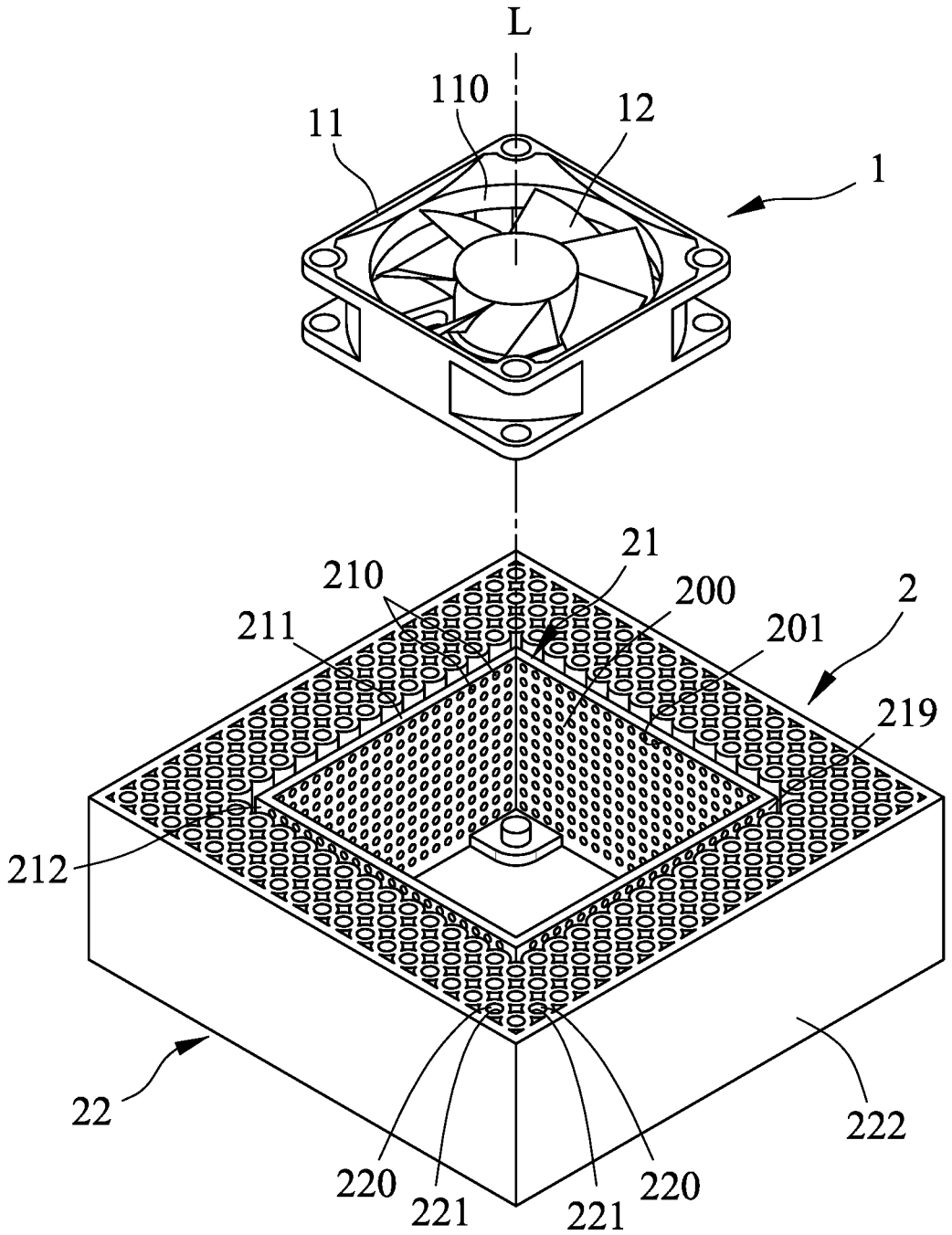
FIG. 1 is a partly exploded perspective view of an embodiment of a fan according to the disclosure.
Figure 2:
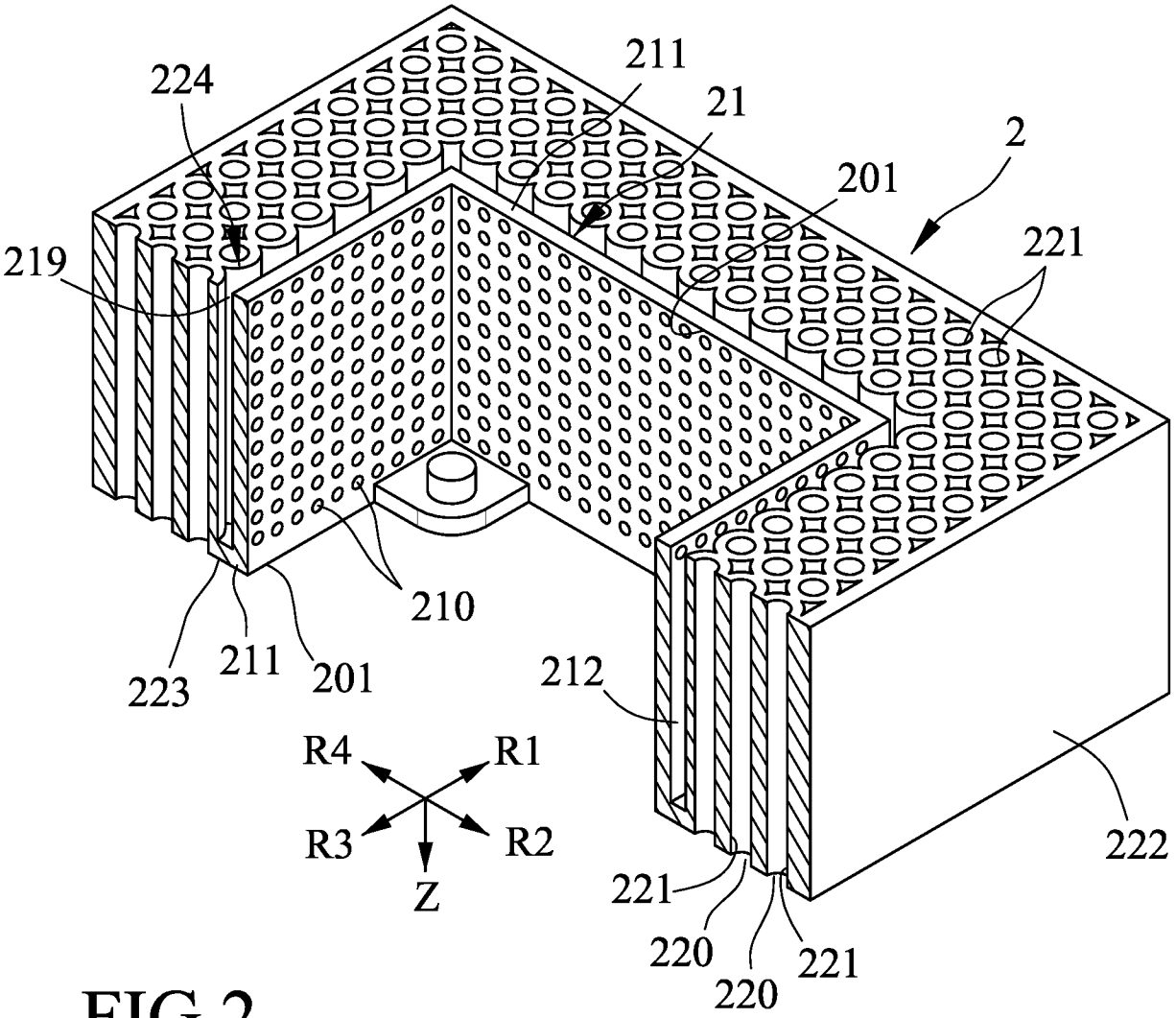
FIG. 2 is a cutaway perspective view of a housing device of the embodiment.
Figure 3:
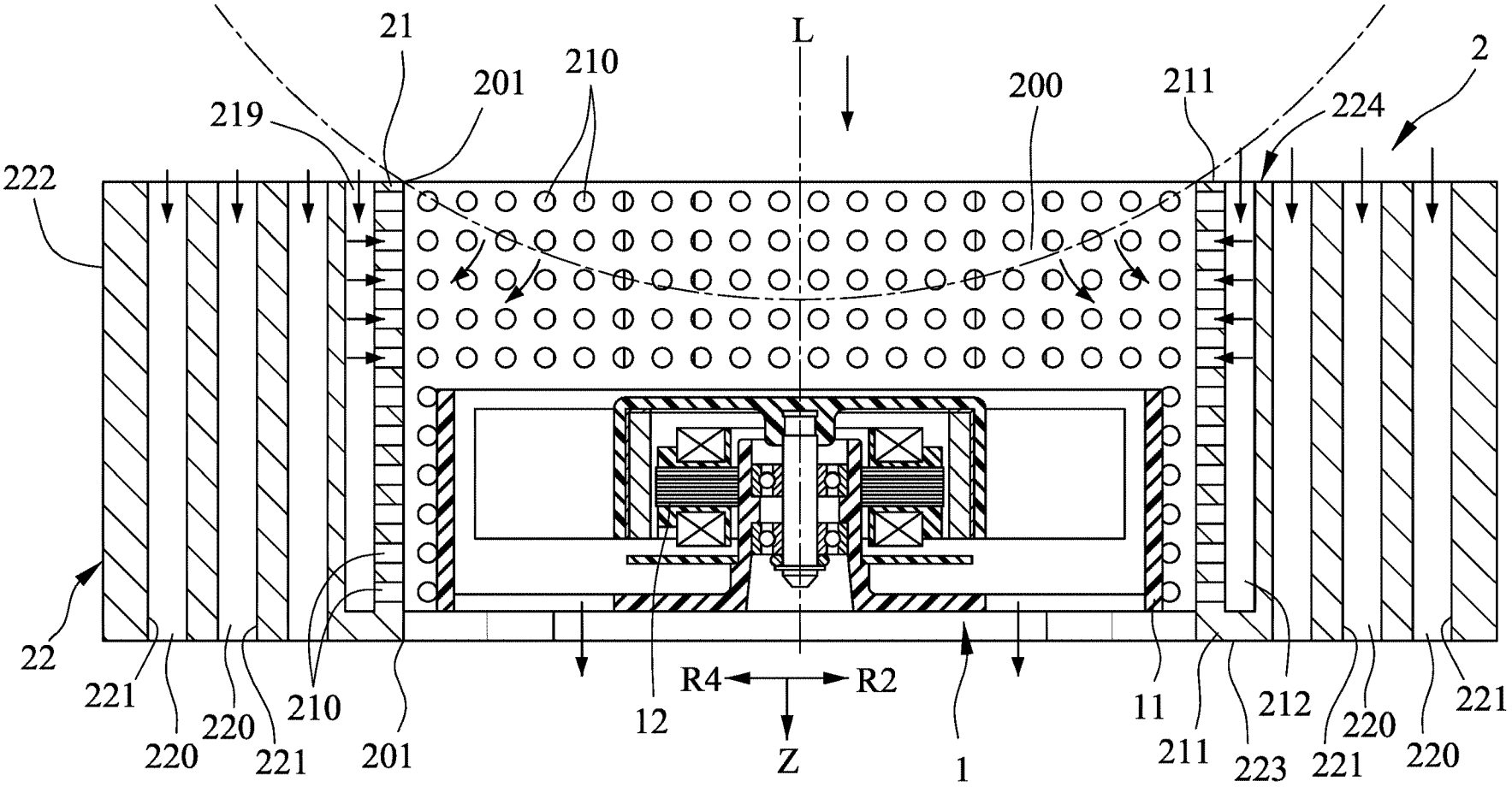
FIG. 3 is a sectional view of the embodiment.

Referring to FIGS. 1 to 3, an embodiment of a fan according to the disclosure includes a rotating unit 1 and a housing device 2 that surrounds the rotating unit 1. The rotating unit 1 includes a frame member 11 and a fan body 12. The frame member 11 surrounds an axis (L) and defines an accommodating space 110. The fan body 12 is disposed in the accommodating space 110 and is rotatable about the axis (L). When the fan body 12 rotates about the axis (L), the fan body 12 urges air to flow therethrough in an axial direction (Z) of the axis (L).

The housing device 2 includes a surrounding plate 21 and a housing unit 22. The surrounding plate 21 surrounds the frame member 11 and is formed with at least one plate hole 210 that extends in a transverse direction (R) transverse to the axial direction (Z) of the axis (L) therethrough. Specifically, the surrounding plate 21 defines an inner space 200 in which the rotating unit 1 is disposed. The surrounding plate 21 has two opposite ends 211 in the axial direction (Z) of the axis (L) that respectively define two space openings 201 through which the inner space 200 communicates with the external environment. When the fan body 12 of the rotating unit 1 rotates, the fan body 12 urges air to flow through one of the space openings 201 into the inner space 200 and exit the inner space 200 through the other one of the space openings 201 (see FIG. 3). In this embodiment, the surrounding plate 21 is formed with a plurality of plate holes 210 that are separated into four groups in which the plate holes 210 respectively extend in a first transverse direction (R1), a second transverse direction (R2), a third transverse direction (R3), and a fourth transverse direction (R4). Each of the first transverse direction (R1), the second transverse direction (R2), the third transverse direction (R3) and the fourth transverse direction (R4) is transverse to the axial direction (Z) of the axis (L). In one embodiment, the surrounding plate 21 may be formed with a plurality of plate holes 210 that respectively extend in a plurality of directions transverse to the axial direction (Z) of the axis (L).

The housing unit 22 surrounds the surrounding plate 21, and has a plurality of housing holes 220, a main section 224, an interconnecting section 223 and a casing plate 222. The housing holes 220 extend in the axial direction (Z) of the axis (L) through the main section 224. The housing unit 22 and the surrounding plate 21 cooperatively define a surrounding space 212 therebetween. In one embodiment, the main section 224 consists of a plurality of tube members 221. The tube members 221 are disposed in a multi-row arrangement to surround the surrounding space 212, abut against each other, and respectively define the housing holes 220 (i.e., the housing holes 220 are disposed in the multi-row arrangement to surround the surrounding space 212). The casing plate 222 surrounds the tube members 221. The main section 224 of the housing unit 22 is spaced apart from the surrounding plate 21. The interconnecting section 223 of the housing unit 22 interconnects the main section 224 of the housing unit 22 and one of the opposite ends 211 of the surrounding plate 21. The main section 224 of the housing unit 22 cooperates with the other one of the opposite ends 211 of the surrounding plate 21 to define a surrounding opening 219 through which the surrounding space 212 communicates with the external environment. In this embodiment, each of the tube members 221 has a circular cross section. However, in certain embodiments, a cross section of each of the tube members 221 may be, but not limited to, quadrilateral or of other shapes. In addition, the housing unit 22 further has a plurality of housing spaces extend in the axial direction (Z) of the axis (L) therethrough. Each of the housing spaces is defined among the tube members 221. Therefore, holes that extend through the housing unit 22 in the axial direction (Z) of the axis (L) are relatively intensively distributed.

By virtue of the housing unit 22 of the housing device 2 having the housing holes 220 and the housing spaces, when the fan body 12 of the rotating unit 1 rotates and urges air to flow from the external environment into the inner space 200 of the housing device 2, part of the air that is not located at the projected area of one of the space openings 201 of the housing device 2 in the axial direction (Z) of the axis (L) flows through the housing holes 220. Referring to FIG. 3 again, the dot-dash broken line illustrates an imaginary boundary of the air that has been urged toward the fan from the same reference plane. Because part of the air flows through the housing holes 220, the air is prevented from being squeezed into the inner space 200, which reduces the likelihood of wind shear and the likelihood that components of the fan will vibrate. Consequently, noise that is generated when the fan is in operation is reduced. Furthermore, by virtue of the housing holes 220 being disposed in the multi-row arrangement, vibration of the fan caused by the flow of the air and the rotation of the fan body 12 is restrained, which further reduces the noise. When the air in the inner space 200 is urged by the fan body 12 to exit the inner space 200, part of the air flows through the plate holes 210 of the surrounding plate 21 into the surrounding space 212 of the housing device 2, and bounces off the main section 224 of the housing unit 22 and into the inner space 200 again. By adjusting parameters such as the shape and the volume of the surrounding space 212, and the volume of the space surrounded by the surrounding space 212, narrowband noise (i.e., noise that lacks a flat spectral density plot) can be reduced, and white noise, which has constant power spectral density, can be generated to obtain impulse responses in order to achieve a relatively better noise-reducing effect for noise with specific frequencies (e.g., harmonic frequencies).

Figure 4:
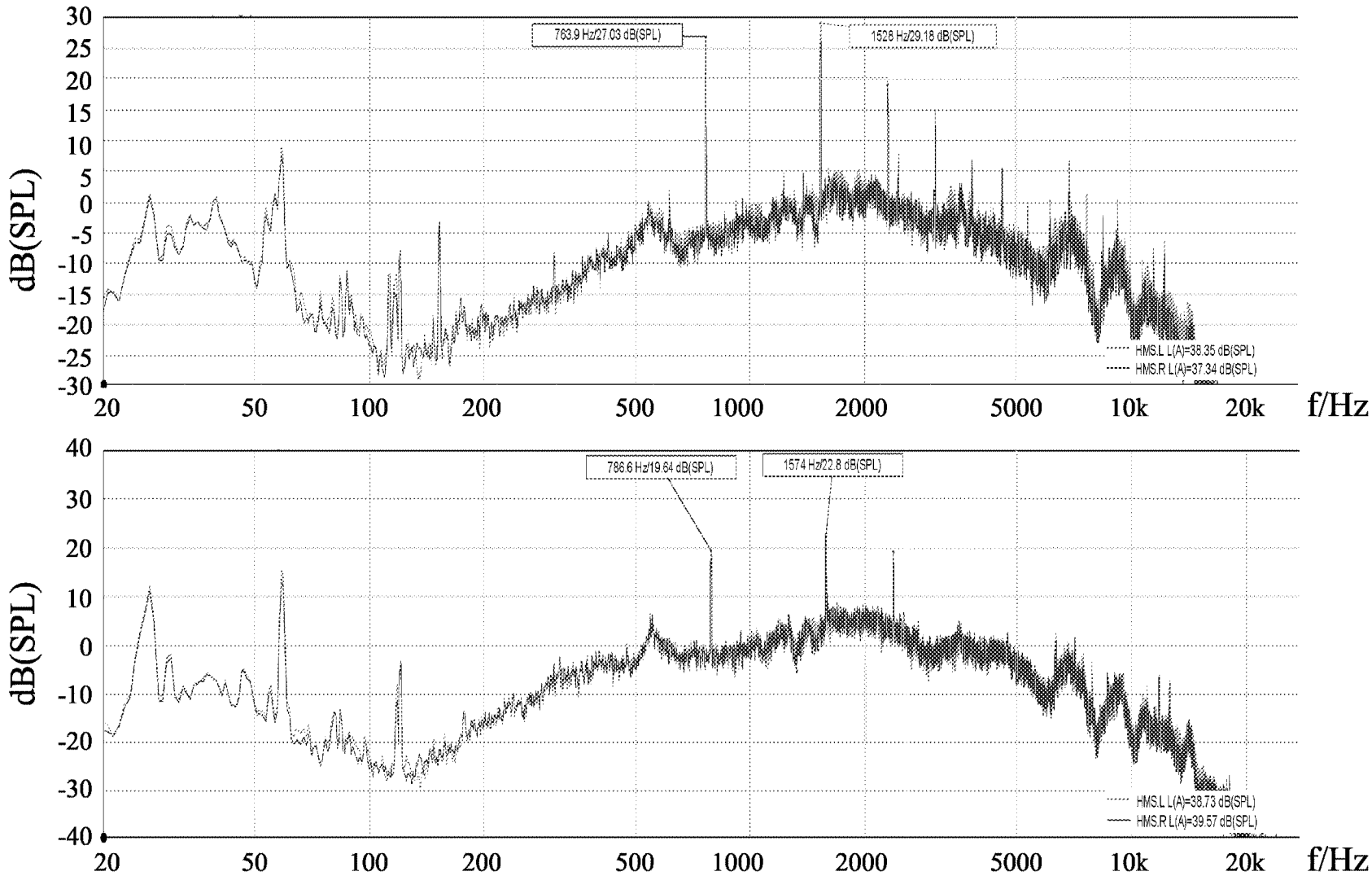
FIG. 4 shows two sound spectrums illustrating a reduction in noise when the embodiment is in operation.

Referring to FIG. 4, sound produced during the operation of the fan body 12 of the rotating unit 1 alone and sound produced during the operation of the fan (i.e., including the housing unit 2) are respectively analyzed, and the results thereof are respectively shown in the upper sound spectrum and the lower sound spectrum. Exemplarily, fundamental frequency of each of the sounds is in a range of 760 to 790 Hz, and harmonic frequency is in a range of 1,520 to 1,580 Hz. The peak decibel values of the fundamental frequency and the harmonic frequency of the fan operating with the housing unit 2 are relatively low compared with the values for operating the fan body 12 of the rotating unit 1 alone. Therefore, it is clear that the fan certainly achieves the effect of noise reduction, especially noise with high frequency.

In summary, by virtue of the housing unit 22 of the housing device 2 having the housing holes 220 and the housing spaces, the likelihood of wind shear and the likelihood that components of the fan will vibrate are reduced. By virtue of the housing holes 220 being disposed in the multi-row arrangement, vibration of the fan caused by the flow of the air and the rotation of the fan body 12 is restrained. By adjusting the characteristics of the surrounding space 212 of the housing device 2, noise with specific frequencies can be reduced. Consequently, the purpose of the disclosure is certainly fulfilled.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A fan comprising:

a rotating unit including a frame member that surrounds an axis and defines an accommodating space, and a fan body that is disposed in said accommodating space and that is rotatable about the axis; and a housing device surrounding said rotating unit and including a surrounding plate that surrounds said frame member and that is formed with at least one plate hole extending in a transverse direction transverse to an axial direction of the axis therethrough, and a housing unit that surrounds said surrounding plate and that has a plurality of housing holes extending in the axial direction of the axis therethrough, said housing unit and said surrounding plate cooperatively defining a surrounding space therebetween, said housing holes being disposed in a multi-row arrangement to surround said surrounding space;

wherein said surrounding plate of said housing device has two opposite ends in the axial direction of the axis; and wherein said housing unit of said housing device has a main section that is spaced apart from said surrounding plate, and an interconnecting section that interconnects said main section and one of said opposite ends of said surrounding plate, said main section of said housing unit cooperating with the other one of said opposite ends of said surrounding plate to define a surrounding opening through which said surrounding space communicates with the external environment.

2. The fan as claimed in claim 1, wherein said housing unit of said housing device includes a plurality of tube members that respectively define said housing holes, and that abut against each other.

3. The fan as claimed in claim 2, wherein said housing unit of said housing device further includes a casing plate that surrounds said tube members.

4. A housing device adapted for a fan, said housing device comprising:

a surrounding plate surrounding an axis, and formed with at least one hole that extends in a transverse direction transverse to an axial direction of the axis therethrough; and a housing unit surrounding said surrounding plate and having a plurality of housing holes that extend in the axial direction of the axis therethrough, said housing unit and said surrounding plate cooperatively defining a surrounding space therebetween, said housing holes being disposed in a multi-row arrangement to surround said surrounding space;

wherein said surrounding plate of said housing device has two opposite ends in the axial direction of the axis; and wherein said housing unit of said housing device has a main section that is spaced apart from said surrounding plate, and an interconnecting section that interconnects said main section and one of said opposite ends of said surrounding plate, said main section of said housing unit cooperating with the other one of said opposite ends of said surrounding plate to define a surrounding opening through which said surrounding space communicates with the external environment.

* * * * *